US005678491A

United States Patent [19]

Price et al.

[11] Patent Number: 5,678,491

[45] Date of Patent: Oct. 21, 1997

[54] PLASTIC TABLE STRUCTURE

[75] Inventors: Mark E. Price, Ft. Smith; Mark A. Rothwell, Greenwood, both of Ark.

[73] Assignee: Alltrista Corporation, Muncie, Ind.

[21] Appl. No.: 459,362

[22] Filed: Jun. 2, 1995

Related U.S. Application Data

[63] Continuation-in-part of Ser. No. 166,207, Dec. 13, 1993, Pat. No. 5,443,020.

[51] Int. Cl.[6] ..... A47B 3/00

[52] U.S. Cl. ..... 108/115; 108/161

[58] Field of Search ..... 108/132, 129, 108/130, 115, 901, 161; 248/188, 6, 439

[56] References Cited

U.S. PATENT DOCUMENTS

| | | | |
|---|---|---|---|
| 2,278,810 | 4/1942 | Virtue et al. . | |
| 2,671,002 | 3/1954 | White . | |
| 2,689,158 | 9/1954 | Mahr . | |
| 2,703,137 | 3/1955 | Bierman | 108/115 X |
| 2,778,700 | 1/1957 | Mayer | 108/115 |
| 2,921,825 | 1/1960 | Spiegel . | |
| 3,097,028 | 7/1963 | Pieschel | 108/129 X |
| 3,187,693 | 6/1965 | Hamilton et al. . | |
| 3,213,570 | 10/1965 | Abramson, Jr. . | |
| 3,266,446 | 8/1966 | Haydock . | |
| 3,319,958 | 5/1967 | Bender . | |
| 3,349,728 | 10/1967 | Barecki et al. | 108/115 X |
| 3,368,504 | 2/1968 | Cohen . | |
| 3,393,887 | 7/1968 | Zackrisson . | |
| 3,416,468 | 12/1968 | Peterson et al. . | |
| 3,476,342 | 11/1969 | Motl et al. . | |
| 3,628,470 | 12/1971 | De Luca . | |
| 3,831,338 | 8/1974 | Klingensmith et al. . | |
| 3,875,873 | 4/1975 | Howitt . | |
| 3,883,104 | 5/1975 | Delafield . | |
| 3,957,268 | 5/1976 | Silberman . | |
| 4,102,587 | 7/1978 | Herb et al. . | |
| 4,358,216 | 11/1982 | Pleickhardt et al. . | |
| 4,362,284 | 12/1982 | Bolante . | |
| 4,383,488 | 5/1983 | Macho et al. . | |
| 4,399,975 | 8/1983 | Trimarco et al. . | |
| 4,444,124 | 4/1984 | Burr . | |
| 4,507,348 | 3/1985 | Nagata et al. . | |
| 4,759,654 | 7/1988 | Martin et al. . | |
| 4,786,119 | 11/1988 | Smuda . | |
| 4,805,541 | 2/1989 | Drane et al. . | |
| 4,951,576 | 8/1990 | Cobos et al. . | |
| 5,002,247 | 3/1991 | Dispensa et al. . | |
| 5,284,100 | 2/1994 | Thorn . | |
| 5,357,872 | 10/1994 | Wilmore . | |
| 5,443,020 | 8/1995 | Price | 108/901 X |

*Primary Examiner*—Jose V. Chen
*Attorney, Agent, or Firm*—Brinks Hofer Gilson & Lione

[57] ABSTRACT

A plastic table structure includes a top having a planar upper surface portion, a lower plastic portion and a central wooden frame including a composite beam interposed between and enclosed by the top and lower portions. A pair of folding leg assemblies for supporting the table are rotatably carried by the lower plastic portion and pivotable between an open, top-supporting position and a retracted, enclosed position in leg-receiving channels formed in the underside of the lower plastic portions. Each leg assembly includes a pair of upper transverse supports that engage the leg-receiving channels of the lower plastic portion and extend across its entire width to provide a plurality of transverse load-bearing interfaces to enhance the rigidity and load-bearing capability of the plastic table.

18 Claims, 6 Drawing Sheets

PLASTIC TABLE STRUCTURE

The present invention is a continuation in part of U.S. patent application Ser. No. 08/166,207 filed Dec. 13, 1993, now U.S. Pat. No. 5,443,020.

FIELD OF THE INVENTION

The present invention relates generally to round table structures and, more particularly, to a large, lightweight plastic table structure using a reinforcing core comprising a composite beam.

BACKGROUND OF THE INVENTION

Numerous types of folding tables structures are known in the prior art, including portable tables having folding legs that include locking means for holding the legs in an operative position. Such tables are commonly used by many groups, including assembly and convention halls, hotels, institutions, churches, meeting establishments and the like, that cater to large groups of people. Large portable folding tables, often referred to as "banquet tables", allow the organizations or institutions to tailor the configurations of banquet rooms to the anticipated requirements of the group. In the event that folding tables are not needed for a particular function or event, they can, of course, be stored. Thus, use of folding tables permits such organizations to maximize the effectiveness and utilization of their available floor space and accompanying facilities, while minimizing the storage space requirements for the tables when they are not needed.

Common problems encountered with some prior art tables are that they are fabricated of heavy materials, often requiring two or more persons to handle the tables. Such tables are typically made of fiber or particle board, plywood, or Masonite-type materials, and may also have a Formica type surface laminated onto one of the foregoing underlying materials. Such tables have frequently been made stronger or sturdier by making the table tops thicker and heavier. Attempts to make the table tops thicker and sturdier only exacerbates the bulkiness and weight problem. Such prior art tables may weigh, for example, 80 to 90 pounds or more for a banquet-sized table.

In the case of round tables, prior art tables have had the unfavorable tendency to flex at the edge whenever a load is placed near the edge. Attempts at strengthening the tables, while exacerbating the bulkiness and weight problems, have had only limited success in dealing with the flexing problem and have thus been inadequate to the task.

Another problem with such prior art folding tables is that the materials used in the tables are susceptible to water damage. Materials which absorb water, or other liquids coming into contact with them prematurely deteriorate and provide an unsightly appearance. Still another problem with such prior art tables is that they can sometimes splinter if subjected to improper loads, or even after periods of routine use. Such splintering is at least annoying and can be hazardous.

One proposed solution to the prior art problems discussed above is to make parts of the table tops from lightweight metals, such as aluminum. Aluminum tables can be expensive for most organizations, tend to dent easily when subjected to the routine wear and tear, and tend to be noisy in normal use. Such tables can also have sharp edges, posing a hazard, like the splinters of the prior art tables discussed above.

Another proposed solution is the use of plastic materials for such tables. U.S. Pat. No. 3,628,470 to De Luca discloses a portable lightweight foldable support platform comprising a planar support member fabricated of a core of lightweight, high-strength material, such as a balsa wood composition, and having a plastic layer secured to the underside of the core and a nonskid textured plastic layer secured to the upper surface of the core. The longitudinal sides of the core have aluminum rails secured thereto.

U.S. Pat. No. 4,951,576, to Cobos, et al., discloses a portable plastic folding table. The table structure includes upper and lower plastic table top halves with a reinforcing framework grid sandwiched therebetween. The framework grid is preferably made of wood, and includes joists or beam members interconnected by reinforcing cross members. The framework grid is received in a correlatively-shaped shell integrally formed in the lower plastic half of the table top. The lower table top half is provided with gussets at selected locations between relatively high vertical walls and the adjacent horizontal planar surfaces. Stiffening ribs, which may be extensions of the shell, are also disposed on the lower table top half.

U.S. Pat. No. 4,951,576 further discloses that the reinforcing cross members and joists of their wooden framework are disposed at locations to provide structural support and rigidity to the plastic-sandwiched table top structure, and to provide attachment and positive mechanical support for the folding legs of the table. In the table of the '576 patent, loads imposed on the ends of the table are carried by the plastic lower half of the table and the only stress relief for the ends of the plastic lower half is at the side rails of the framework. Therefore, gusset means are provided in the underside corners of the lower plastic half to maintain its structural integrity.

Notwithstanding these developments, a need exists for a portable, lightweight yet strong, foldable table structure with improved load bearing characteristics, especially a structure which provides support at the periphery of a round table to prevent the table top from flexing at the table periphery.

SUMMARY OF THE INVENTION

This invention provides a portable, lightweight and strong round table top. The table top of the invention is reinforced by a separate reinforcing core, and by one or more folding leg assemblies. The table top comprises a top plastic portion that forms a planar upper surface, a lower plastic portion that engages the top portion, in part, and forms a plurality of downwardly extending recessed portions with the reinforcing core disposed therebetween. The reinforcing core comprises a composite beam that includes, preferably, a wooden member and at least one other member made of ribbon steel attached to the wooden member. Preferably, the one or more leg assemblies include elongated table top supporting members that are received and retained by, and engage and support, the lower plastic table portion transversely of the table top in positions to supplement the reinforcing core, thus increasing the table strength, reducing its weight, and permitting better utilization of the reinforcing effect of the core.

The table structure of the invention comprises, in one embodiment, an upper plastic portion comprising a planar upper surface, a lower plastic portion, and a central reinforcing core interposed therebetween. The table further includes external leg support means affixed to the lower portion for supporting the table above a floor surface, and means formed in the lower table portion for receiving and securing the external leg support means to the table structure. The upper and lower plastic portions of the table structure are of substantially the same peripheral size and shape and are disposed in a close-fitting relation. Bracket means can be disposed and enclosed between the upper and lower table portions for securing the reinforcing core and the lower table portion.

The lower portion includes a network of downwardly extending recesses integrally formed in relief fashion therein for receiving and partially enclosing the central reinforcing core, including a plurality of strengthening ribs integrally formed therein for providing stability and localized rigidity to the table structure. The lower portion of the table structure preferably includes at least two relatively deep longitudinal recesses formed in relief fashion in the lower portion adjacent each opposing longitudinal edge thereof, and preferably at least one relatively shallow transverse recess formed in relief fashion in the lower portion.

The central core interposed between and enclosed by the upper and lower portions preferably comprises at least two beam members extending longitudinally of the structure in parallel fashion, first and second end pieces extending transversely between the beam members proximal to the opposite ends thereof, and at least one composite beam cross member extending transversely between and affixed to the beam members and arranged centrally between the first and second end pieces and positioned parallel thereto. The two beam members and the first and second end pieces can form a rectangle when assembled, and the first and second end pieces can extend into stiffening ribs disposed at the ends of the lower plastic table portion. The first and second end pieces can have rounded corners to match the lower table portion and are preferably let into notches of the beam members. In larger tables of the invention (e.g., about eight feet in diameter) a plurality of composite beam cross members can extend transversely between the beam members in parallel spaced-apart relation. In smaller tables of the invention (e.g., about six feet in diameter), the central core includes a single composite beam cross member extending between the beam members generally at the center of the table.

The composite beam includes a first member and a second member fastened to the first member. In preferred embodiments, a third member is fastened to the first member and positioned opposite the second member. The first member is preferably wood and the second and third members are preferably ribbon steel and fastened to the top and bottom, respectively, of the first member. The second and third members are preferably fastened to the first member with adhesive, but mechanical fasteners may be used. The first member can also include a plurality of sub-members bonded together to form a T-shape.

According to one aspect of the invention, the composite beam includes first and second steel ribbons and means for maintaining the first and second steel ribbons in parallel spaced-apart relation.

In an alternative embodiment of the invention, the composite beam includes a plurality of composite beams disposed in parallel spaced-apart relation. The plurality of composite beams extend substantially across the round planar top surface.

The external support means of this invention comprises leg assemblies longitudinally spaced and positioned adjacent opposite ends of the lower portion. Each leg assembly can include transversely extending support members to interface the recesses formed in the lower table portion for retention therein to secure the leg assembly to the table and to support the lower table portion across its entire width.

The means formed in the underside of the lower plastic portion for receiving and securing the external support means comprises a plurality of portions adapted to receive the leg assemblies, preferably by the network of recesses forming leg-receiving channels or saddles. The leg assemblies are pivotally secured within the leg-receiving channels or saddles by retaining brackets and fasteners. Preferably, transversely extending leg members are rotatably received in the network of recesses, allowing the leg assembly to be folded between open and retracted closed positions.

Other features and advantages of the invention will be apparent from the drawings and more detailed description that follows.

DETAILED DESCRIPTION OF THE BEST MODE

Figure 1:
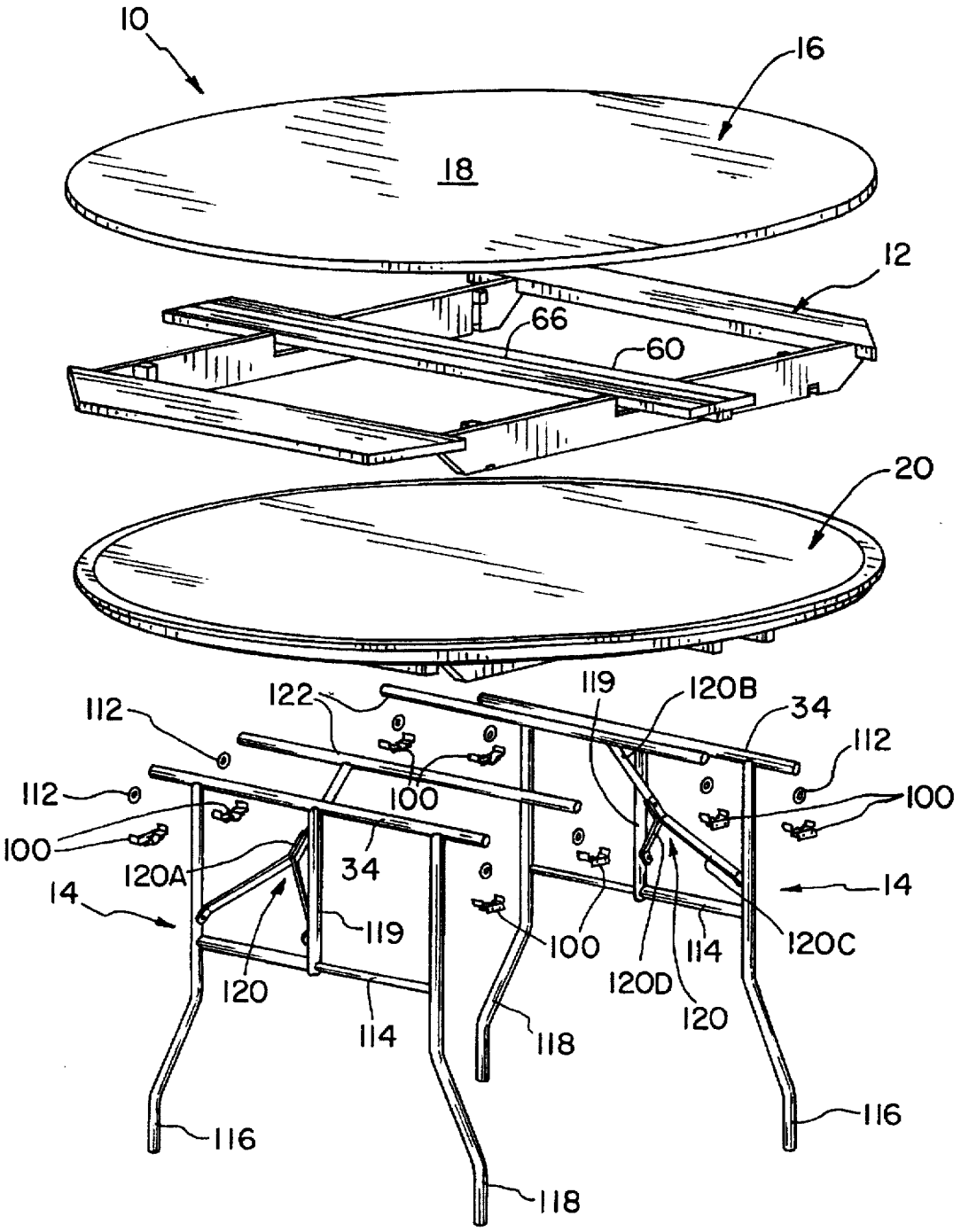
FIG. 1 is an exploded perspective view of a preferred embodiment of the table structure of this invention.
Figure 2A:
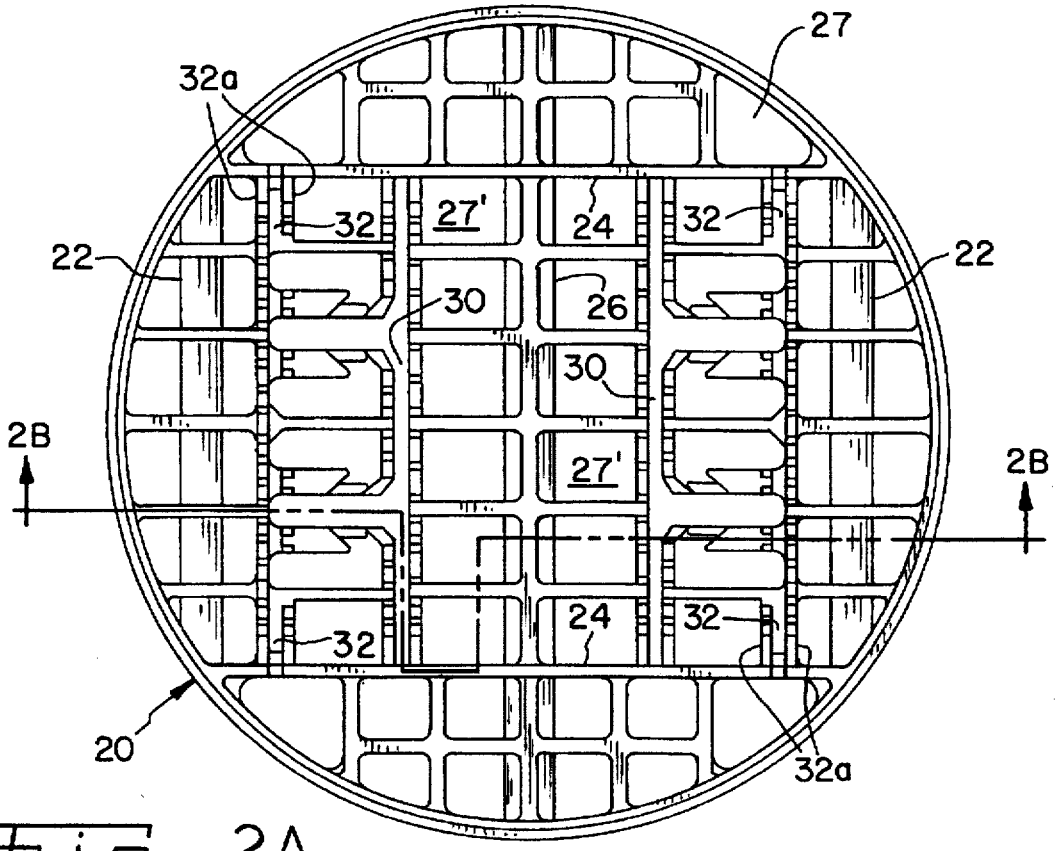
FIG. 2A is a plan view of the lower portion of a preferred embodiment of the table of this invention with the upper portion removed for illustration.
Figure 2B:
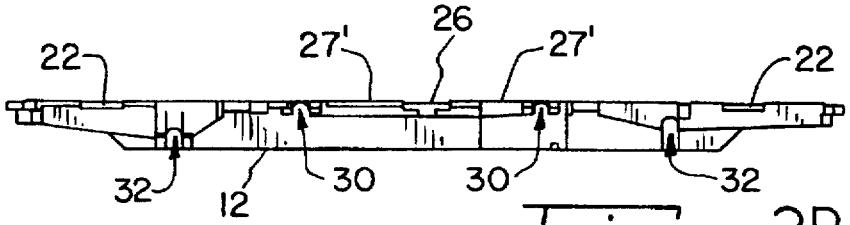
FIG. 2B is a section view taken along lines 2B—2B in FIG. 2A.
Figure 3:
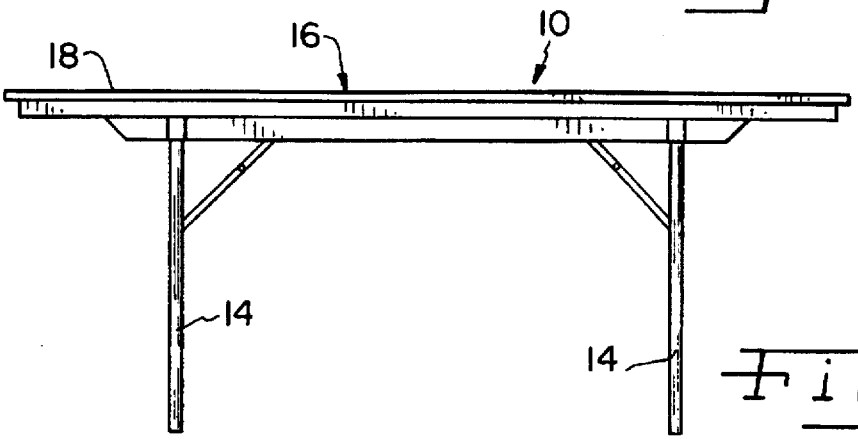
FIG. 3 is a side elevational view of the table of FIG. 1.

As shown in FIGS. 1–4, this invention provides a round table top 10, preferably plastic, that is reinforced by a separate reinforcing core 12 (FIGS. 1, 4 and 5) and one or more folding leg assemblies 14 (FIGS. 1 and 3). The table top 10 comprises a top portion 16 forming a planar upper surface 18, a lower plastic portion 20 forming a plurality of downwardly extending, recessed portions 22, 24, 26 (FIG. 2A) for receiving the reinforcing core 12, and a plurality of upper portions 27 engaging the top portion 16. The folding leg assemblies 14 are received in and rotatably carried by leg-receiving surfaces, such as channels 30 and saddles 32, formed by the plurality of downwardly recessed portions of the lower plastic portion 20 of the table top 10. Preferably, the one or more leg assemblies 14 include elongated table top supporting members 34 (FIGS. 1, and 7–8) that are received and retained by leg-receiving portions 32 of the lower plastic portion 20 and engage and support the table top 10 at locations that supplement the reinforcing core 12, thus increasing the table strength, reducing its weight, and permitting better utilization of the reinforcing effect of the core.

The embodiment of the table structure 10 of the invention shown generally in FIGS. 1–4 comprises a round table top 10 including a top portion 16 and a lower plastic portion 20 in registry with the top portion 16, a central reinforcing core 12 interposed between and enclosed by the upper and lower portions 16 and 20, external support means 14 affixed to the lower portion 16 for supporting the table above a floor surface. The upper and lower portions 16 and 20 of table structure 10, which are both preferably formed from plastic, are of substantially the same peripheral size and shape and are disposed in a close-fitting relation as is known in the art.

Referring to FIG. 2A, lower portion 20 is shown from above with upper portion 16 removed for clarity. Lower portion 20 includes a network of recesses 22, 24, 26, 30, 32, 34 and 36 integrally formed in relief fashion, extending downwardly therein, for receiving and partially enclosing the reinforcing core 12, for providing a plurality of strengthening ribs for adding rigidity to table structure 10, and for locating and rotatably engaging and retaining folding leg assemblies 14 for supporting the table top 10. The lower plastic table portion 20 further forms a plurality of upper portions 27 for engaging the underside of the top portion 16 forming the planar top surface, wherein each of the plurality of upper portions 27 includes a bearing surface 27' for supporting and bonding to, the top portion 16 of the table top 10.

Figure 4A:
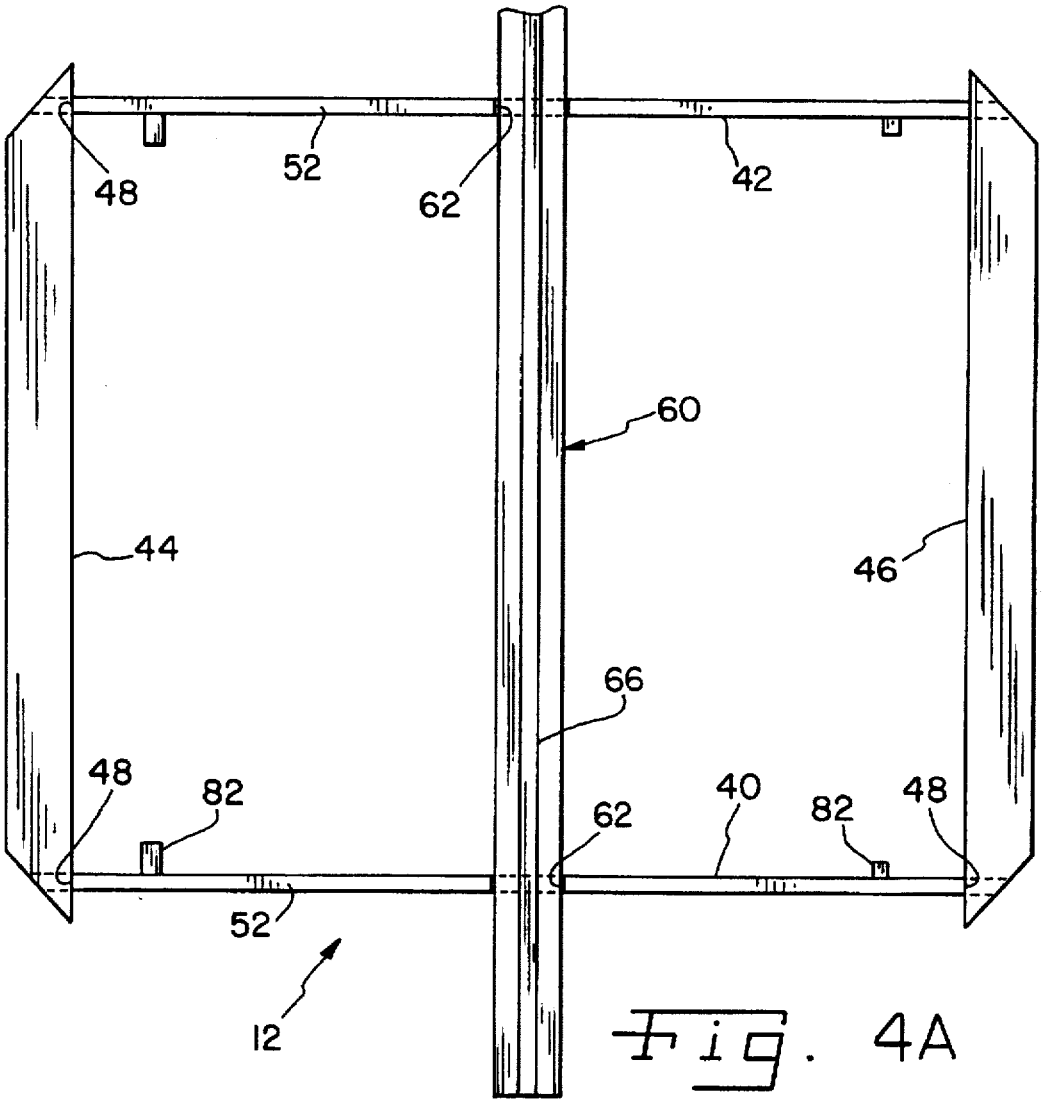
FIG. 4A is a top plan view of the central core framework of the table of FIG. 2.
Figure 4B:
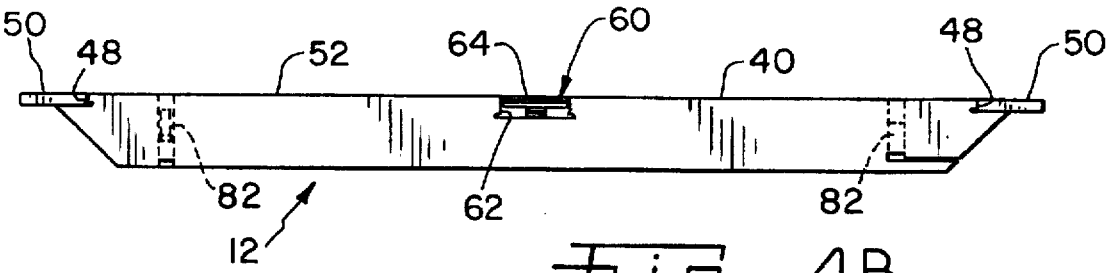
FIG. 4B is a side elevation thereof.
Figure 4C:
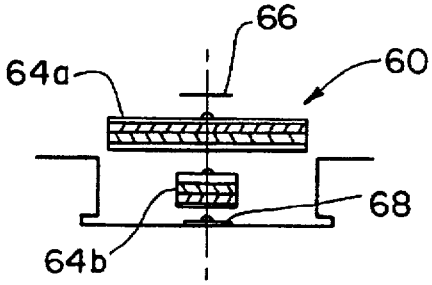
FIG. 4C is an exploded end view of a composite beam of the invention.

Referring now to FIGS. 4A–4C, the central reinforcing core 12 interposed between and enclosed by the upper and lower portions 16 and 20 can comprise at least two beam members 40 and 42 extending in parallel fashion, first and second end pieces 44 and 46 extending orthogonally to and between the beam members 40 and 42 proximal to the opposite ends thereof and a composite beam cross member 50 extending orthogonal to, and between, the center portion of beam members 40, 42.

The reinforcing core 12 of the preferred embodiments of this invention can be constructed from wood, wood products, steel or other metal tubing, or plastic.

As shown in FIG. 4A, beam members 40 and 42 and the end pieces 44 and 46 form a rectangle when assembled with their respective ends disposed in an end-to-end relation. End pieces 44 and 46 have external corners cut to approximate the periphery of the round top portion of 16. End pieces 44 and 46 are set into notches 48 formed in beam members 40 and 42 to provide a planar upper surface 50 for engagement with the lower surface of top portion 16. As shown in FIG. 4B, beam members 40 and 42 are disposed with their deepest dimension vertical while end pieces 44 and 46 and composite beam cross members 60 disposed with their longest dimension horizontal. The end pieces and cross member are attached to beam members 40 and 42 so that the upper flat faces 50 thereof are substantially flush with the upper side edges 52 of the beam members 40, 42 and with bearing surfaces 27' of the upper portions 27 of lower plastic table portion 20.

The reinforcing core 12 further includes as a novel feature a composite beam cross member 60, including a first member 64 with at least one second member fastened thereto, supported by the beam members 40 and 42 and extending beyond them to the periphery of the table. The composite beam 60 rests in notches 62 formed in beam members 40, 42 and includes a first member 64 preferably interposed between second and third members 66 and 68, respectively. The second and third members 66, 68 are bonded or otherwise attached to the top and bottom surfaces, respectively, of the first member 60, and extend along the length of the first member 60. Thus, in this preferred embodiment the first member 64 maintains the second and third members 66, 68 in parallel, spaced-apart relation. The notches 62 are cut to a depth so that the top surface of the composite beam 60, i.e., the top surface of the second member 66, is flush with the upper side edges 52 of the beam members 40, 42.

The first member 64 is preferably a solid piece of wood, such as pine or balsa (FIGS. 5C and 5D), but can include plywood or other forms of laminated wood or wood products, plastic, or metal. As shown in FIGS. 4B and 4C, the first member 64 can also include a plurality of sub-members **64*a*, 64*b* bonded together to form a unit. As shown in FIGS. 4B and 4C, the sub-member 64*b* form a thinner, downwardly extending web portion and a T-shaped first member 64 that can provide increased rigidity in first member 64 while minimizing its weight. The second and third members 66, 68** are preferably made from ribbon steel, such as the type used for baling cotton. It has been found that the ribbon steel has outstanding engineering properties suitable to this application. It will be appreciated, however, that other materials, such as plastics or other metals, having similar engineering properties may be used instead of ribbon steel.

Figure 5A:
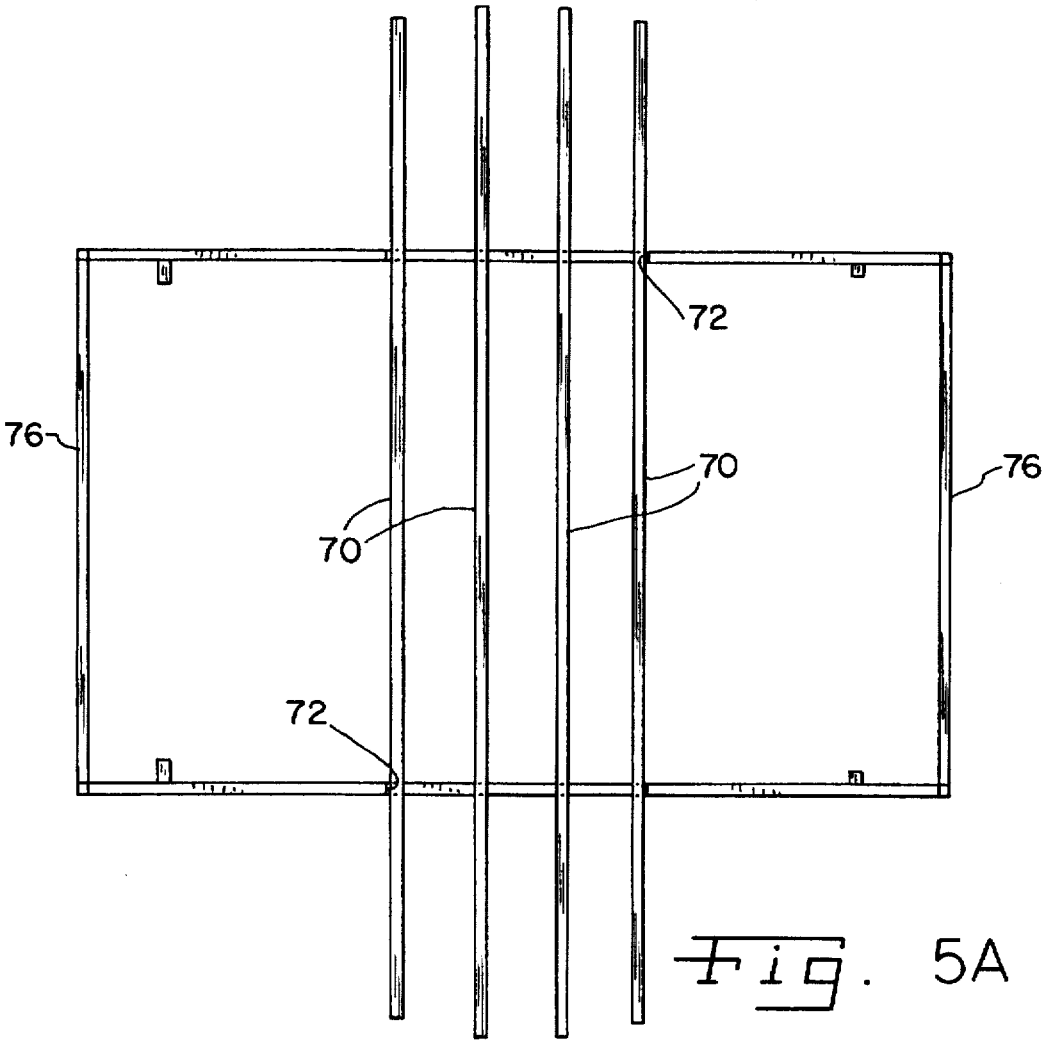
FIG. 5A is a plan view of an alternative embodiment of a central core framework.
Figure 5B:
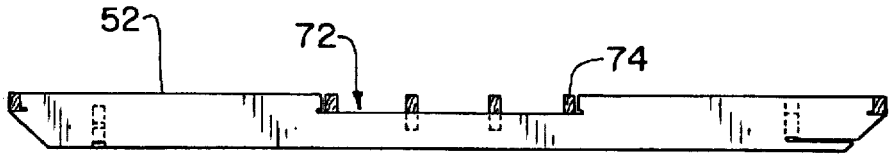
FIG. 5B is a side elevation thereof.
Figure 5C:
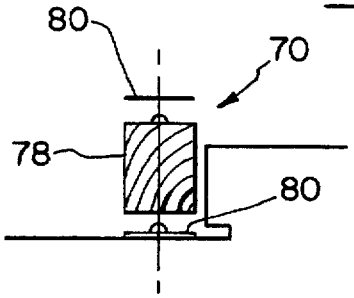
FIGS. 5C and 5D are exploded end views of composite beams used in the embodiment.
Figure 5D:
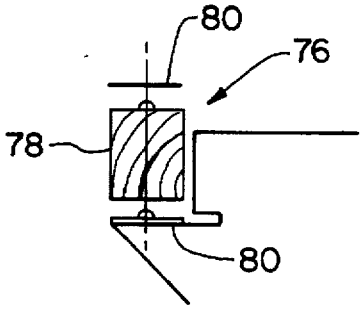

Alternatively, as shown in FIGS. 5A–5B, the reinforcing core 12 can include a plurality of composite beam cross members 70 extending in parallel spaced-apart relation to each other. In the alternative embodiment, extended notches 72 are cut into the upper side edges of the beam members 40, 42 and the composite beam cross members 70 rest in the notches 72. As in the embodiment of FIGS. 4A–4C, the notches 72 are cut to a depth to allow the uppermost surface 74 of the composite beam cross members 70 to lie flush with the upper side edges 52 of the beam members 40, 42. Also shown in FIGS. 5A–5D, end pieces 76 positioned at the ends of the beam members 40, 42 can be composite beams. As previously described, composite beams 70, 76 can include a solid piece of wood 78 with one or more steel ribbons bonded or otherwise fastened to the top and bottom of the piece of wood 78.

Referring again to FIG. 2, lower portion 20 of table structure 10 preferably includes at least two relatively deep stiffening ribs 24 defining longitudinally extending recesses extending downwardly in relief fashion in the lower portion 20 for receiving and partially enclosing the two beam members 40 and 42. Shallow transverse recesses 22 are formed in relief fashion adjacent the ends of stiffening ribs 24 to receive and partially enclose each of the first and second end pieces 44 and 46. Transverse recess 26 is formed in relief fashion centrally to the stiffening ribs 24 to receive and partially enclose the composite beam cross member 60. Of course, in the embodiment of FIG. 5, multiple transverse recess can be formed to accommodate the plurality of composite beam cross members 70.

Figure 6A:
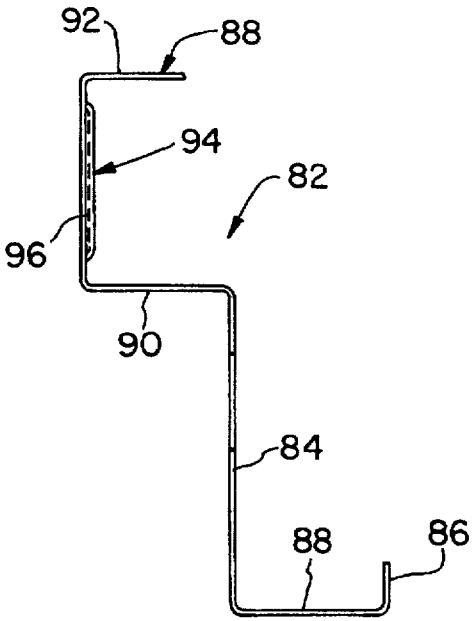
FIG. 6A is a side view of a hanger for transferring loads to leg assemblies.
Figure 6B:
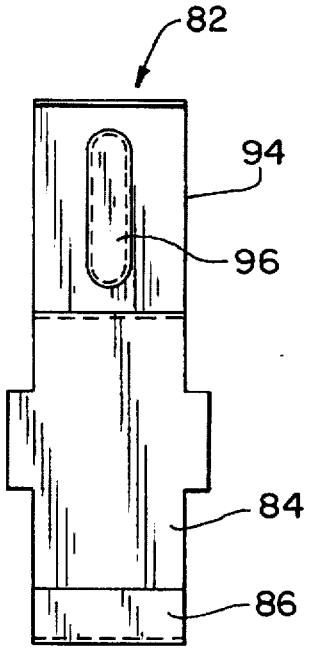
FIG. 6B is a front view thereof.
Figure 8:
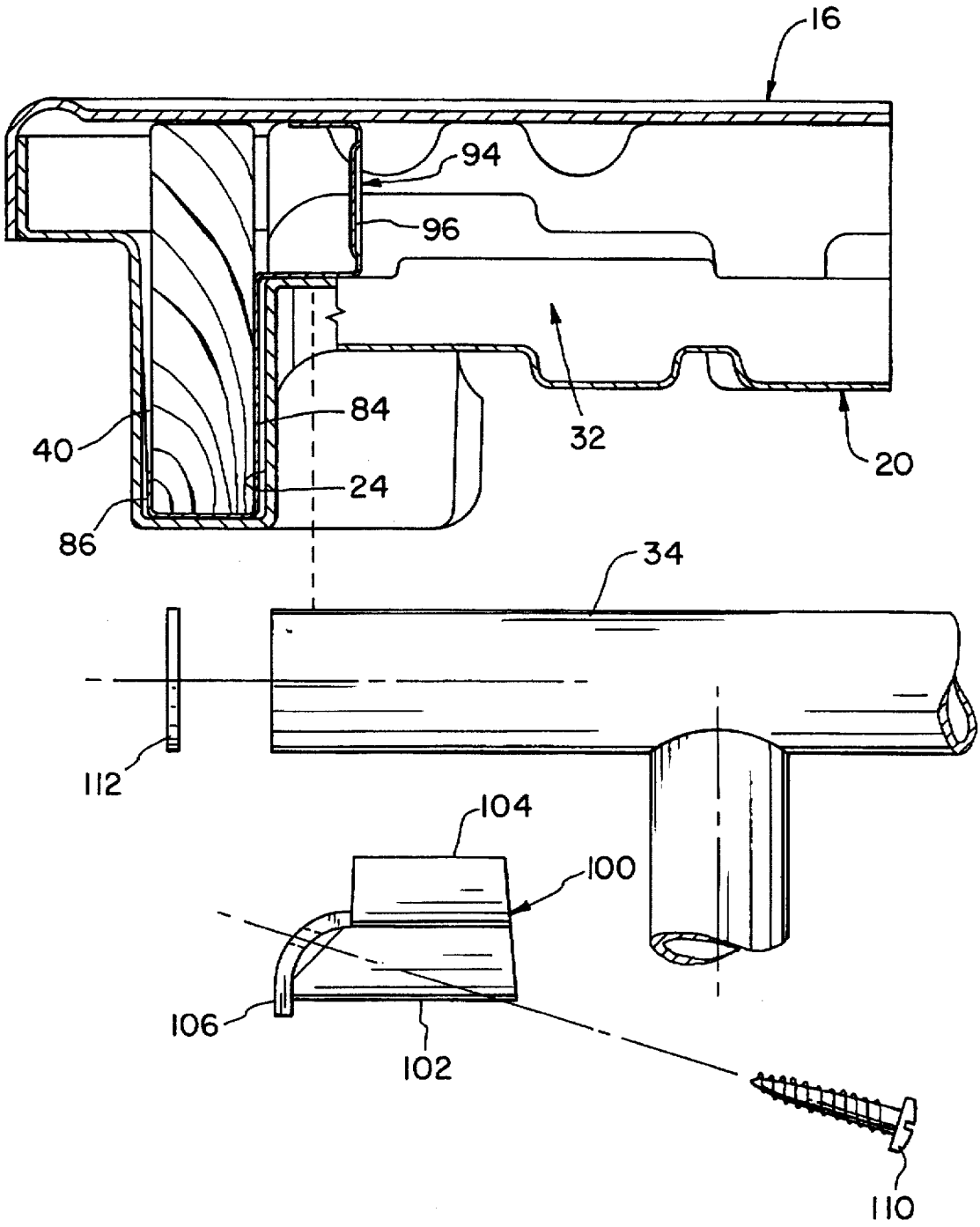
FIG. 8 is an exploded side view of the leg-mounting showing the relationship between the leg-receiving saddles formed in the table, the leg assembly and the leg-mounting bracket.

Hanger means 82 of the structure 10, shown in FIGS. 6A–6B and 8 provide a novel and concealed means for transferring loads imposed on reinforcing core 12 to leg assemblies 14 positioned in saddles 32. Hanger means 82 comprises one or more load bearing metal hangers, each having an inner leg 84, an outer leg 86 and a transverse portion 88 connecting the inner leg and the outer leg at their lower ends so that the legs 84 and 86 are disposed in a parallel fashion to define a U-shaped cross section. The inner leg 84 is preferably longer than the outer leg and has a shoulder portion 88 extending outwardly therefrom in a direction away from the outer leg 86. The shoulder portion 88 defines a U-shaped channel lying on its side and opening toward the outer leg 86. In preferred embodiments, the shoulder portion 88 includes lower and upper horizontal legs 90, 92, respectively and a vertical leg 94 extending therebetween. An elongated blister 96 is formed in the vertical leg 94 to improve resistance to buckling and assist in transferring load forces from the reinforcing core 12 to the leg assemblies 14, as explained further below.

Figure 7:
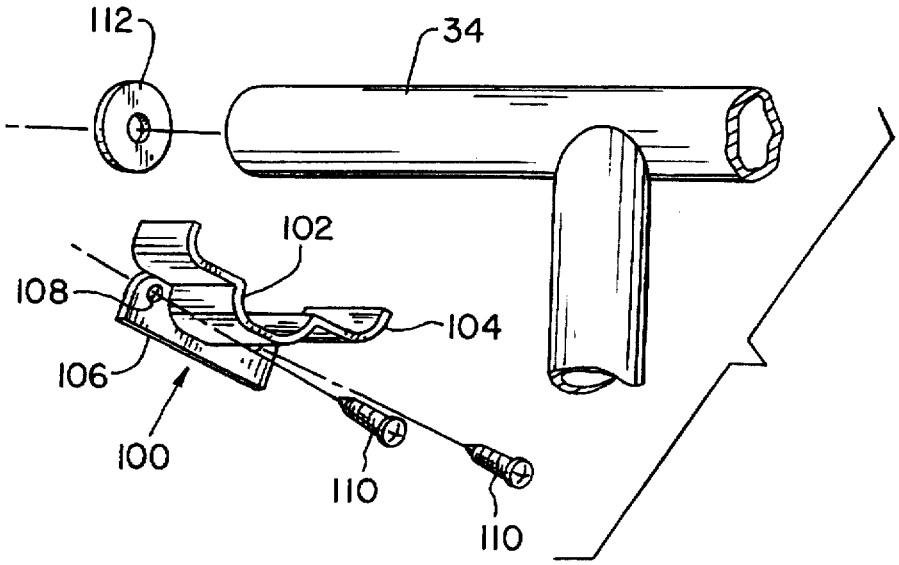
FIG. 7 is an exploded perspective view showing the relationship between the leg assembly and leg-mounting brackets as used in the invention.

Leg-mounting brackets 100, shown in FIGS. 7 and 8, are configured to conform to the tubular table top supporting members 34 of leg assemblies 14 and retain the supporting members 34 for rotational movement within saddle 32. Each bracket 100 includes a semi-cylindrical portion 102 with a generally L-shaped shoulder 104 extending from each side thereof for engaging the sidewalls 32*a* of saddles 32. Thus, the semi-cylindrical portion 102 cooperates with the saddle 32 to define a tubular retainer for mounting the leg assemblies 14 to the table top 10.

In use, as shown in FIG. 8, hangers 82 are disposed in an upwardly facing fashion within the deep recesses 24 of lower portion 20, with the shoulder portion 82 of inner leg 84 in an overlapping engagement with the lower plastic portion 20, preferably positioned over tubular supporting member 34 of the folding leg assembly 14 to transfer table top loads directly to the legs.

Hangers 82 are attached to the reinforcing core 12, as shown in FIGS. 4A and 4B, before the table top is assembled. As indicated in FIG. 8 (which shows beam member 40). Each beam member 40 and 42 is received between the inner and outer legs 84 and 86 of the hanger 82 with the lower longitudinal edge of the beam member abutting the transverse portion 88 of the hanger 82.

A novel leg-mounting system comprises a plurality of leg-mounting brackets 100, shown illustratively in FIGS. 7–8. Each bracket 100 includes an upwardly opening, semi-cylindrical, leg-engaging portion 102, a pair of generally L-shaped, recess-engaging arms 104 extending radially outwardly from the semi-cylindrical portion 102 and curving upwardly, and a curved portion 106 extending from one end of the semi-cylindrical portion 102 and curving downwardly from the semi-cylindrical portion 102. Preferably, a pair of holes 108 are formed in the curved portion 106 for receiving screws 110, or other suitable fasteners. In use, the screws 110 extend through the holes 108 to engage the sidewall of the deep recess 24 and the beam members 40, 42.

The external support means of this invention preferably comprise leg assemblies 14, as shown in FIGS. 1 and 3, positioned diametrally opposite each other adjacent the lower plastic portion 20. Each leg assembly 14 includes a first upper transversely extending cross support 34 to rotatably interface with the saddles 32 (discussed further below) formed in the lower table portion 20 for retention therein to secure the leg assembly 14 to table 10 and to support the lower table portion 20. Ends 112 of cross support 34 are rotatably received and retained in saddles 32 adjacent each side of recesses 24, allowing the leg assembly 14 to be folded between open and closed positions. Leg assemblies 14 can further include a lower cross member 114 secured to and extending between opposing legs 116, 118. A center vertical brace 119 can extend from the lower cross member 114 to upper cross support 34.

Folding support or brace 120 provides a second cross support 122 which is received in leg-receiving channels 30 of lower portion 20 (FIG. 2A). The second cross support 122 of the folding leg assembly engages the entire extent of leg-receiving channel 30 formed in the lower plastic portion 20 at a location spaced from the first cross support 34 of the folding leg assembly.

In the embodiment shown in FIG. 3 both the first and second cross supports 34 and 122 of the folding leg assembly 14 engage the lower plastic table portion 20 in leg-receiving channels 32 and 30, respectively, throughout the portion extending between deep ribs 24 and structurally support the table top 10 between the deep ribs 24 adjacent these spaced channels, which lie between the end pieces 44, 46 and the composite beam cross members 60 of reinforcing core 12, thus permitting increased loads to be applied, to the table top without exceeding the stresses at which the table top may break or buckle.

As shown in FIG. 2B, first cross support 34 is disposed slightly lower than second transverse cross support 122. In engagement with the lower plastic portion 20, the second transverse cross support 122 engages the lower plastic portion 20 in channels 30, which, as shown in FIG. 3B, are higher than channels 32 in which the first cross support 34 is received, permitting the leg assemblies 14 to fold into a position that is retracted within the network of recesses. This retracted position of the folded leg assemblies 14 permits close stacking of the tables 10.

Folding brace 120 can include a hinge device 120A so that leg assembly 14 can be moved between an extended operative position shown in FIGS. 1 and 3 and a retracted storage position with the leg assemblies 20 folded flat against the lower plastic portion 20 within its leg-receiving recesses. Folding brace 120 is preferably provided with an inverted Y-shape with a single upper extension 120B extending between the second cross support 122 and the hinge device 120A, and two lower extensions 120C and 120D extending from the hinge device 120A downwardly and outwardly to leg 116 and center vertical brace 119 of leg assembly 14. Hinge 120 can further include a locking pawl of the conventional type permitting the rotation of the folding brace 120, and accordingly the leg assembly 14, only in an inward direction toward the underside of the lower table portion 20. The second cross support element 122 may, if desired, be rotatably retained in leg-receiving channel 30.

During assembly of table structure 10, the hangers 82 are applied to the beam members 40 and 42 of core 12, preferably about 10–12 inches from end pieces 44 and 46, at locations corresponding to the locations of each of saddles 32 formed in the underside of lower plastic portion 20. After the lower plastic portion 20 and reinforcing core 12 (with hangers 82) are assembled, the first cross support 34 of one leg assembly 14 is positioned within the saddles 32 and the second cross support 122 is positioned within an additional leg-carrying channel 30 disposed inwardly from the saddles 32. Folding leg assemblies 14 are then rotatably secured at ends 122 in the saddles 32 by brackets 100 which span the saddles 32 and are secured in position by fasteners 110. Preferably, a washer 112 is positioned between the ends of the cross supports 34 and 122 and the sidewall of deep recess 24 to eliminate erosion of the sidewall material due to rotation of the leg assembly 14. The fasteners 110, typically anchor screws or the like, extend through holes 108 in brackets 100, through the inner wall of the deep recess 24 of lower plastic portion 20 through or around the hanger 82 disposed within the deep recess 24, and into the beam member 40, 42 received within the hanger 82. The hangers 82 are concealed within the upper and lower table portions 16 and 20.

When the table structure 10 is set up in an operative position such as that shown in FIG. 3, leg assemblies 14 provide transverse load bearing interfaces for table 10 at four additional locations, e.g., the pair of first transverse cross supports 34 and the pair of second transverse supports 122, spaced intermediate of the end pieces 44, 46 of reinforcing core 12 to enhance the strength of table 10. Accordingly, the co-action of leg-carrying channels 32 and 30 and tubular transverse leg assembly supports 34 and 122 not only secures the folding leg assemblies 14 to the table, but further acts to strengthen the plastic table by providing a plurality of transverse load-bearing reinforcing interfaces and increased table torsional stiffness. In addition, hangers 82 assist in transferring load forces carried by the reinforcing core 12 and its sidewalls 40 and 42 to the leg assemblies 14, as apparent from FIG. 8.

The upper and lower portions of table 10 can be inexpensively formed from a durable, relatively strong, substantially water-, or other liquid-, impervious, and relatively lightweight plastic. Thermoplastics such as acrylonitrile butadiene styrene ("abs"), polyethylene, polypropylene, high impact polystyrene, polyvinylchloride or the like, can be used. Thermosetting plastic materials may also prove suitable. Upper and lower table portions 22 and 30 can be constructed by utilizing any suitable conventional plastic manufacturing process, such as blow molding, injection molding, or vacuum molding. In some tables of the invention, the upper portion 22 of the table may be a material other than plastic.

The table top halves may be bonded together with any suitable adhesive or by any suitable process so long as a strong, permanent, and preferably waterproof, bond is achieved between the portions 22 and 30. Suitable adhesives include methacrylic, thermoset urethane or a solvent-type cement.

As noted above, unlike the prior art tables, tables of this invention have quite different load bearing characteristics and utilize the coaction of a novel reinforcing core and the pairs of transverse leg assembly supports to distribute load support over the table top and to improve stress bearing capabilities at the periphery of the table. The invention also provides novel and convenient installation and attachment of the table legs to the lower table portion, and eliminates the need for any cement or adhesive between the central framework and the table top and the problem of a framework grid which may float between the table top halves. In the table of this invention, there is no need to allow for a thermal expansion or contraction of the table top halves with respect to the central wooden core 50 to avoid damage to the table top. Finally, this table 10 further eliminates the need for the separate leg supporting brackets that can provide stress concentration in the plastic table portion and require mounting to the reinforcing core.

While the device and method described above constitutes a presently preferred embodiment, the invention can take many other forms. Accordingly, it should be understood that the invention is to be limited only insofar as is required by the scope of the following claims.

What is claimed:

1. A table structure, comprising:

an upper portion comprising a round planar top surface;

a lower plastic portion having a first surface portion for engaging the upper portion and a plurality of downwardly extending recessed portions; and a reinforcing core interposed between said upper and lower portions, the reinforcing core including a composite beam having a structural member and a reinforcing member fastened to the structural member substantially along its longitudinal extent.

2. The table structure of claim 1 wherein said first member has a substantially wooden composition and said second member has a substantially metallic composition.

3. A table structure, comprising:

an upper portion comprising a round planar top surface;

a lower plastic portion having a first surface portion for engaging the upper portion and a plurality of downwardly extending recessed portions; and a reinforcing core interposed between said upper and lower portions, the reinforcing core including a composite beam wherein said composite beam includes a first member and a second member fastened to the first member, and wherein the first member includes a wood beam having a top surface and the second member includes a metal strap fastened to the top surface of the beam.

4. The table structure of claim 3 further including a third member fastened to a bottom surface of the beam.

5. The table structure of claim 1 wherein the composite beam extends diametrally across the round planar top surface.

6. The table structure of claim 1 wherein the composite beam includes a plurality of composite beams disposed in parallel, spaced apart relation, the plurality of composite beams extending substantially across the round planar top surface.

7. A table structure, comprising:

an upper portion comprising a round planar top surface:

a lower plastic portion having a first surface portion for engaging the upper portion and a plurality of downwardly extending recessed portions; and a reinforcing core interposed between said upper and lower portions, the reinforcing core including a composite beam, wherein the composite beam includes first and second steel ribbons and means for maintaining the first and second steel ribbons in parallel, spaced-apart relation.

8. A table structure comprising:

an upper portion comprising a round planar upper surface;

a lower plastic portion having a generally downwardly extending peripheral flange, the peripheral flange of said lower portion being substantially adjacent to the edges of the planar surface of said upper portion; and a reinforcing core interposed between and enclosed by said upper and lower portions, said lower portion including a network of recesses integrally formed therein for receiving said core;

external support means for supporting the table structure above a floor surface; and means formed in the lower plastic portion for receiving and securing the external support means to said structure, wherein said reinforcing core includes a composite beam having a structural member and a reinforcing member fastened to the structural member substantially along its longitudinal extent.

9. The table structure of claim 8 wherein the external support means includes at least one bracket configured to rotatably couple the external support means to the lower plastic portion.

10. The table structure of claim 9 wherein the at least one bracket includes a semi-cylindrical portion, a pair of substantially L-shaped shoulders extending from the semi-cylindrical portion to engage the lower plastic portion, and a curved portion extending from the semi-cylindrical portion to engage the reinforcing core.

11. The table structure of claim 8 wherein the reinforcing core further includes a first pair of parallel rails and a second pair of parallel rails, the first and second pairs of parallel rails being orthogonal to each other and cooperative to form a generally rectangular structure, the first and second pairs of rails extending horizontally, the first pair of rails being vertically oriented and the second pair of rails being horizontally oriented an positioned at the ends of the first pair of rails and fastened to the first pair rails.

12. The table structure of claim 11 wherein the composite beam includes at least one composite beam disposed in parallel relation to the second pair of rails and extending beyond the first pair of rails to the periphery of the round planar upper surface, the at least one composite beam being supported by the first pair of rails.

13. A table structure comprising:

an upper portion comprising a round planar upper surface;

a lower plastic portion having a generally downwardly extending peripheral flange, the peripheral flange of said lower portion being substantially adjacent to the edges of the planar surface of said upper portion; and a reinforcing core interposed between and enclosed by said upper and lower portions, said lower portion including a network of recesses integrally formed therein for receiving said core;

external support means for supporting the table structure above a floor surface; and means formed in the lower plastic portion for receiving and securing the external support means to said structure, wherein said reinforcing core includes a composite beam, said composite beam including a first women member having a top surface and a bottom surface, and a second metal member fastened to the top surface of the wooden member.

14. The table structure of claim 13 wherein the composite beam further includes a third metal member fastened to the bottom surface of the wooden member.

15. A plastic table, comprising:

a top having a substantially flat circular body;

a circular plastic base affixed to said top;

a central wooden frame interposed between and enclosed by said top and plastic base, said top, plastic base and women frame forming a table top when assembled;

a pair of leg assemblies for supporting said table top above a floor surface, each leg assembly being pivotable between a retracted storage position and an extended operative position, said leg assemblies being spaced apart and positioned to provide stable support of said table top; and means for securing said leg assemblies to said circular plastic base of said table top;

said plastic base comprising a plurality of stiffening ribs and deep and shallow recesses integrally formed therein in relief fashion, said recesses being adapted, in part, to receive and partially enclose said central wooden frame in position to support said top; and one or more leg-carrying channels integrally formed by the recesses in the underside of said plastic base for receiving therein said leg assemblies; and bracket means for rotatably securing said pair of leg assemblies to said plastic base and table top, said central wooden frame comprising a composite beam having a first wooden member and a second metal member fastened to the first wooden member along at least a portion of its longitudinal extent to enhance the longitudinal rigidity of the first wooden member.

16. The plastic table of claim 15 wherein the central frame further includes a pair of parallel side rails, each said side rail being disposed on its edge with respect to vertical in a recess integrally formed in relief fashion in the plastic base of said table top;

a pair of end cross members extending between and affixed to said side rails proximal to the opposing ends of said side rails, each said end cross member being disposed flat with respect to horizontal in a recess integrally formed in relief fashion in the plastic base of said table top;

said composite beam extending beyond and affixed to said side rails and disposed in a recess integrally formed in relief fashion in the base of said table, said composite beam being disposed in parallel relation to said pair of end cross members.

17. The table structure of claim 1, comprising a table construction having leg assemblies with tubular cross members and a lower plastic portion formed to include semi-cylindrical leg-receiving recesses having outer walls, and a bracket for rotatably coupling the tubular cross members to the lower plastic portion and retaining the tubular cross members in the leg-receiving recesses, the bracket including a semi-cylindrical portion, a pair of substantially L-shaped shoulders extending from the semi-cylindrical portion to engage the outer walls of the leg-receiving recesses, and a curved portion extending from the semi-cylindrical portion to engage the lower plastic portion.

18. The table structure of claim 1 wherein the composite beam structure extends circumferentially around the periphery and said composite beam structure is disposed in a recess of a downwardly extending periphery flange.

* * * * *

UNITED STATES PATENT AND TRADEMARK OFFICE

CERTIFICATE OF CORRECTION

PATENT NO. : 5,678,491
DATED : October 21, 1997
INVENTOR(S) : Mark E. Price, et al.

It is certified that error appears in the above-indentified patent and that said Letters Patent is hereby corrected as shown below:

In Col. 11, at line 29, delete "women" and insert therefor --wooden--.

In Col. 11, line 42, delete "women" and insert therefor --wooden--.

Signed and Sealed this

Twenty-seventh Day of October, 1998

*Attest:*

*Attesting Officer*

Bruce Lehman

BRUCE LEHMAN

*Commissioner of Patents and Trademarks*